US009882283B2

(12) United States Patent
Kawata

(10) Patent No.: US 9,882,283 B2
(45) Date of Patent: Jan. 30, 2018

(54) PLANE-SHAPED ANTENNA WITH WIDE BAND AND HIGH RADIATION EFFICIENCY

(71) Applicant: Yamaha Corporation, Hamamatsu-shi, Shizuoka (JP)

(72) Inventor: Akihiro Kawata, Aichi (JP)

(73) Assignee: Yamaha Corporation, Hamamatsu-shi (JP)

( * ) Notice: Subject to any disclaimer, the term of this patent is extended or adjusted under 35 U.S.C. 154(b) by 12 days.

(21) Appl. No.: 14/407,315

(22) PCT Filed: Jun. 14, 2013

(86) PCT No.: PCT/JP2013/066499

§ 371 (c)(1),
(2) Date: Dec. 11, 2014

(87) PCT Pub. No.: WO2013/187509

PCT Pub. Date: Dec. 19, 2013

(65) Prior Publication Data

US 2015/0162664 A1 Jun. 11, 2015

(30) Foreign Application Priority Data

Jun. 14, 2012 (JP) ..... 2012-134795
Feb. 12, 2013 (JP) ..... 2013-024551

(51) Int. Cl.
*H01Q 9/26* (2006.01)
*H01Q 1/38* (2006.01)
(Continued)

(52) U.S. Cl.
CPC ..... *H01Q 9/26* (2013.01); *H01Q 1/243* (2013.01); *H01Q 1/38* (2013.01); *H01Q 7/00* (2013.01); *H01Q 9/065* (2013.01); *H01Q 9/42* (2013.01)

(58) Field of Classification Search
CPC .. H01Q 9/26; H01Q 1/24; H01Q 1/38; H01Q 7/00
(Continued)

(56) References Cited

U.S. PATENT DOCUMENTS 7,164,387 B2 * 1/2007 Sievenpiper ..... H01Q 1/243 343/700 MS
7,358,906 B2 * 4/2008 Sato ..... H01Q 1/243 343/700 MS
(Continued)

FOREIGN PATENT DOCUMENTS

JP 2004-172912 A 6/2004
JP 2005-167619 A 6/2005
(Continued)

OTHER PUBLICATIONS

International Search Report (PCT/ISA/210) dated Sep. 17, 2013, with English translation (two (2) pages).
(Continued)

*Primary Examiner* — Jessica Han
*Assistant Examiner* — Jae Kim
(74) *Attorney, Agent, or Firm* — Crowell & Moring LLP

(57) ABSTRACT

An antenna has the following formed on a plane thereof: a vertical element formed in a vertical direction; a left horizontal element formed on a left side of the vertical element; a right horizontal element formed on a right side of the vertical element; a left short stub that connects the left horizontal element and a left upper corner of a ground pattern; and a right short stub that connects the right horizontal element and a right upper corner of the ground pattern. The right and left horizontal elements have a flat plate shape and a capacity hat.

6 Claims, 12 Drawing Sheets

(51) Int. Cl.

| | |
|---|---|
| ***H01Q 7/00*** | (2006.01) |
| ***H01Q 9/06*** | (2006.01) |
| ***H01Q 1/24*** | (2006.01) |
| ***H01Q 9/42*** | (2006.01) |

(58) Field of Classification Search
USPC ..... 343/700 MS, 845
See application file for complete search history.

(56) References Cited

U.S. PATENT DOCUMENTS

| | | | | |
|---|---|---|---|---|
| 7,605,764 | B2 * | 10/2009 | Ishimiya | H01Q 7/00 343/702 |
| 9,124,007 | B2 * | 9/2015 | Yamagajo | H01Q 1/36 |
| 2005/0153756 | A1 | 7/2005 | Sato et al. | |
| 2007/0285321 | A1 | 12/2007 | Chung et al. | |
| 2008/0048929 | A1 * | 2/2008 | Channabasappa | H01Q 1/38 343/895 |
| 2008/0169981 | A1 | 7/2008 | Hotta et al. | |
| 2008/0266190 | A1 | 10/2008 | Ohba et al. | |
| 2009/0115683 | A1 | 5/2009 | Kurashima et al. | |
| 2009/0201210 | A1 | 8/2009 | Teshima et al. | |
| 2010/0033380 | A1 * | 2/2010 | Pascolini | H01Q 1/243 343/700 MS |
| 2010/0201588 | A1 | 8/2010 | Chen et al. | |
| 2011/0134002 | A1 | 6/2011 | Suto et al. | |
| 2011/0210897 | A1 * | 9/2011 | Byun | H01Q 1/243 343/749 |
| 2013/0194139 | A1 * | 8/2013 | Nickel | H01Q 5/328 343/703 |

FOREIGN PATENT DOCUMENTS

| | | | |
|---|---|---|---|
| JP | 2005-203878 | A | 7/2005 |
| JP | 2008-177668 | A | 7/2008 |
| JP | 2008-278219 | A | 11/2008 |
| JP | 2009-118027 | A | 5/2009 |
| JP | 2009-194477 | A | 8/2009 |
| JP | 2009-290452 | A | 12/2009 |
| JP | 2011-130210 | A | 6/2011 |
| WO | WO 2012/160947 | A1 | 11/2012 |

OTHER PUBLICATIONS

Japanese-Language Office Action issued in counterpart Japanese Application No. 2016-165173 dated May 9, 2017 with English translation (7 pages).

* cited by examiner

□ L=5w
◇ L=11w
△ L=15w
○ L=17w
▽ L=19w

□ D=3w

◇ D=5w

△ D=7w

▽ D=9w

○ D=11w

PLANE-SHAPED ANTENNA WITH WIDE BAND AND HIGH RADIATION EFFICIENCY

TECHNICAL FIELD

The present invention relates to an antenna having a plane shape formed in a printed circuit board and the like.

BACKGROUND ART

Along with the high integration and miniaturization of portable electronic devices such as smartphones, there have been demands for the miniaturization of antennas embedded therein. In addition, along with an increase in a communication speed, characteristics of portable electronic devices change due to a circuit layout within a housing, the influence of a user's hand, and the like. Accordingly, there have been demands for a wide band of an antenna so as to enable high-speed communication and to be capable of compensating for changes in characteristics. For this reason, for example, an antenna disclosed in Patent Literature 1 has been proposed.

CITATION LIST

Patent Literature

Patent Literature 1: JP-A-2009-290452

SUMMARY OF INVENTION

Technical Problem

In the antenna of Patent Literature 1, a disc-shaped antenna element is provided on a ground plane and a plurality of short stubs connecting an end of the antenna element and the ground plane are provided. The antenna can be configured to be at a low profile and to have a wide band by forming the antenna element in a disc shape, and a resonance frequency can be changed by adjusting the lengths of the short stubs.

However, in the antenna of Patent Literature 1, the ground plane, the antenna element, and a side wall are three-dimensionally provided. Accordingly, it is not easy to manufacture such antenna, and a housing accommodating the antenna is required to have an accommodation space in a height direction. In addition, it is necessary for the ground plane to be sufficiently larger than the antenna element, and thus there is a limitation on the miniaturization of the antenna.

An object of the present invention is to provide an antenna which is formed in a plane shape and has a wide band and satisfactory radiation efficiency.

Solution to Problem

An antenna according to an aspect of the present invention is configured to have the following formed on a plane thereof: a ground pattern that has an upper side, which is a side having an antenna element formed thereon, and a left side and a right side with the upper side interposed therebetween; a vertical element that is formed in a vertical direction from the upper side; a left branch line that is branched to a left side from a top of the vertical element; a right branch line that is branched to a right side from the top of the vertical element; a left horizontal element that is formed in a flat plate shape so as to have a gap on a left side of the vertical element and is connected to the left branch line; a right horizontal element that is formed in a flat plate shape so as to have a gap on a right side of the vertical element and is connected to the right branch line; a left short stub that has one end connected to the left horizontal element and the other end connected to the ground pattern; and a right short stub that has one end connected to the right horizontal element and the other end connected to the ground pattern.

The antenna may be configured such that the right and left horizontal elements have a flat plate shape in which a length of the right and left horizontal elements in a direction from the top of the vertical element to the ground pattern is equal to or greater than 1/16 and equal to or less than 1/6 of a resonant wavelength of the antenna, and the left short stub is connected to a left end of the upper side of the ground pattern, and the right short stub is connected to a right end of the upper side of the ground pattern.

An aspect ratio of each of the right and left horizontal elements may be smaller than two times.

The right and left short stubs may be formed so as to meander between the respective right and left horizontal elements and the respective right and left ends of the upper side.

A left antenna element constituted by the left horizontal element and the left short stub may be asymmetrical to a right antenna element constituted by the right horizontal element and the right short stub.

Capacitors may be inserted into the right and left horizontal elements, or inductors may be inserted into the short stubs.

Advantageous Effects of Invention

According to the present invention, it is possible to realize a planar antenna having a wide band and high efficiency.

DESCRIPTION OF EMBODIMENTS

Figure 1:
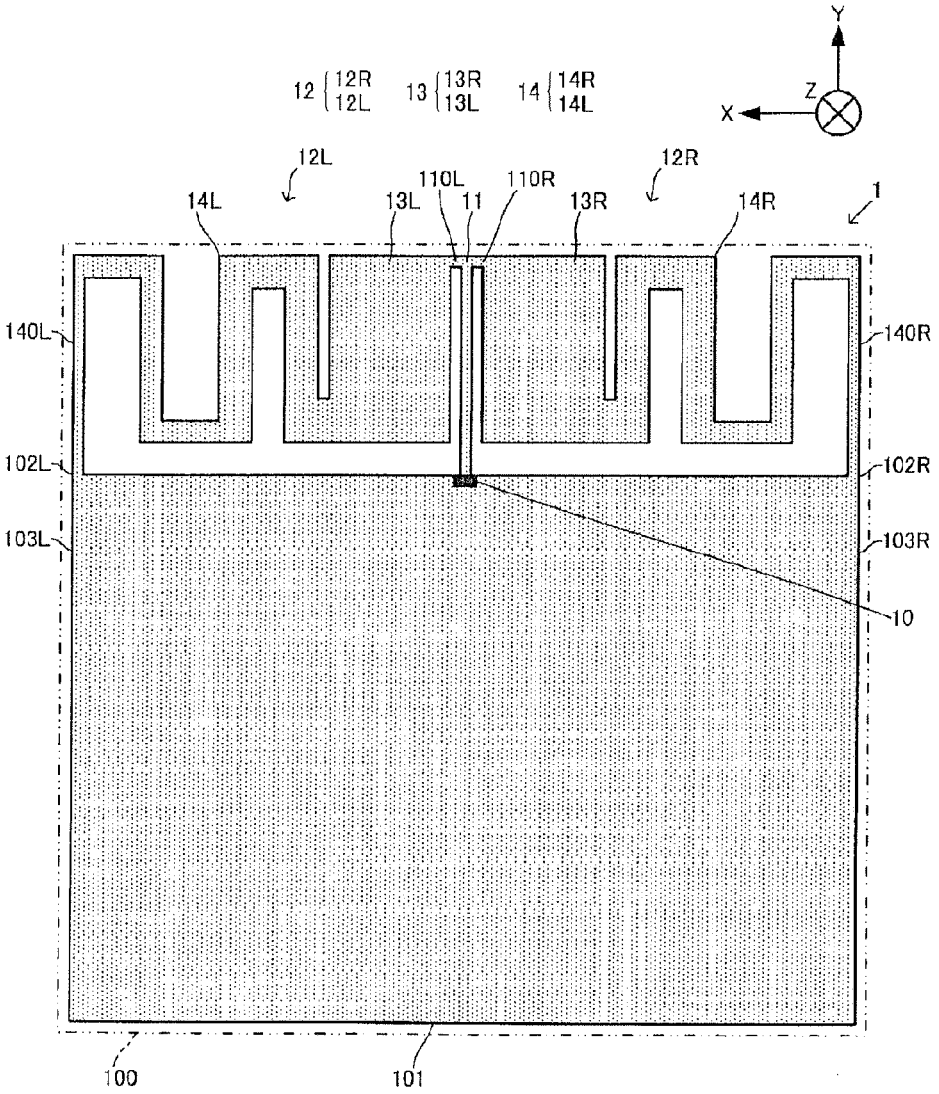
FIG. 1 is a configuration diagram of an antenna according to an embodiment of the present invention.
Figure 8:
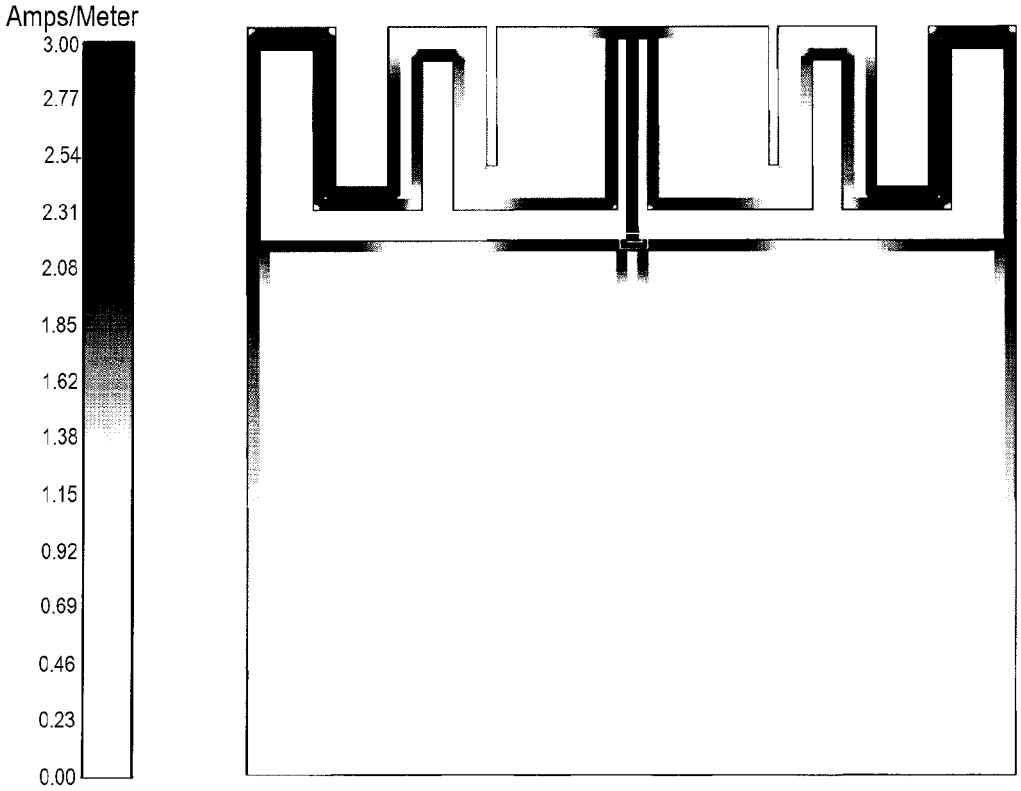
FIG. 8 is a diagram showing the current density distribution of the antenna.

An antenna according to an embodiment of the present invention will be described below with reference to the accompanying drawings. FIG. 1 is a diagram showing a planar structure of an antenna 1 according to an embodiment of the present invention. In addition, FIG. 8 is a diagram showing the current density distribution of the antenna 1. The antenna 1 is a planar pattern antenna which is created by forming a pattern in copper foil attached to a circuit board 100 which is a dielectric body through etching or the like. As the circuit board 100, for example, glass epoxy FR4 ($\in r$=4.7) having a thickness of 1 mm (having a shortening coefficient of wavelength of 60% to 70%) is used.

In the following description, directions (vertical and horizontal directions) in the drawing are used as directions of the pattern antenna 1. In addition, a coordinate axis for representing directional characteristics of the pattern antenna 1 is set as indicated by arrows shown in FIG. 1. That is, an x-axis is set to a direction from the right to the left of FIG. 1, a y-axis direction is set to a direction from the bottom to the top of FIG. 1, and a z-axis is set in a direction from the front to the back of FIG. 1.

The ground pattern 101 is formed to have a substantially rectangular shape across the entire width of the surface of the circuit board 100. A feeding point 10 is provided in the middle of an upper side of the ground pattern 101, and a vertical element 11 is taken out upwards from the feeding point 10. The vertical element 11 ascends straight from the feeding point 10 and is branched into right and left branch lines 110R and 110L at the upper end thereof. A left antenna element 12L is connected to the left branch line 110L, and a right antenna element 12R is connected to the right branch line 110R. Thus, the antenna 1 has an approximately T-shape. The right and left antenna elements 12R and 12L are symmetrical to each other with respect to the vertical element 11, and thus the left antenna element 12L will be only described below.

A left horizontal element 13L is formed in the left branch line 110L of the vertical element 11. The left horizontal element 13L extends further toward an upper side of the ground pattern 101 than a lower end of the left branch line 110L, and thus a gap is provided between the vertical element 11 and the left horizontal element 13L. The left horizontal element 13L is formed in a flat plate shape having a height of approximately 85% and a width of approximately 55% with respect to the length of the vertical element 11 or having a height approximately seventeen times and a width approximately eleven times the width of the vertical element 11, and has a relatively large capacitance. In this manner, since the element having a large capacitance is connected to the tip of the vertical element 11, the antenna 1 serves as a capacity hat antenna, and thus it is possible to set a low resonance frequency as compared to the length of the element.

Meanwhile, a structure of the antenna will be described. A horizontal element 13 refers to a linear portion which orthogonally extends to the vertical element 11 along the upper side from the branch line 110. A square portion provided below the horizontal element 13 so as to be continuous therewith is a plane for a capacity hat. In the following description, all of these will be referred to as the horizontal element 13 for the purpose of simplifying the description. The horizontal element 13 is generally formed in a substantially rectangular shape. When a ratio of the short side to the long side thereof is smaller than 1:2 (made close to a square), it is possible to sufficiently increase capacitance components to be larger than inductance components. Meanwhile, a capacity hat value of the horizontal element 13 can be adjusted only by providing a slit in the pattern having a wide width.

Further, a left short stub 14L is formed toward a left upper end of the circuit board 100 from a left lower end from the left horizontal element 13L. The left short stub 14L extends in the left while meandering up and down, and is connected to the ground pattern 101 at a connection point 102L at the left upper end of the ground pattern 101. The left short stub 14L of FIG. 1 is taken out in the left direction from the left horizontal element 13L and is connected to the ground pattern 101 by repeatedly meandering (ascending and descending) twice, but the number of times of the meandering is arbitrary. In this embodiment, the left short stub 14L is formed so that a pattern width gradually becomes narrower, but the pattern width is also arbitrary. Adjustment to an electrical length and width according to an intended resonance frequency (wavelength) of the antenna 1 may be performed.

The left side of a descending portion 140L at the left end of the left short stub 14L conforms to a left side 103L of the ground pattern 101. Thus, when a left direction is observed from the feeding point 10, a shape similar to a T-shape antenna is obtained by the descending portion 140L of the short stub 14L and the left side 103L of the ground pattern 101. As shown in FIG. 8, a portion having the shape similar to the T-shape antenna has a high current density, and thus it can be understood that a significant contribution to the electromagnetic wave radiation of the antenna 1 is made.

Meanwhile, it is found by an experiment that characteristics do not become critical with respect to a change in the size of the ground pattern 101 by causing the short stub 14 to reach the connection point 102 from the horizontal element 13 while gradually reducing the width of the short stub.

The left antenna element 12L has been described so far. However, the right and left sides of the right antenna element 12R are just inverted with respect to the left antenna element 12L and thus have the same shape as the left antenna element 12L. Accordingly, a description thereof will be omitted here.

Figure 2:
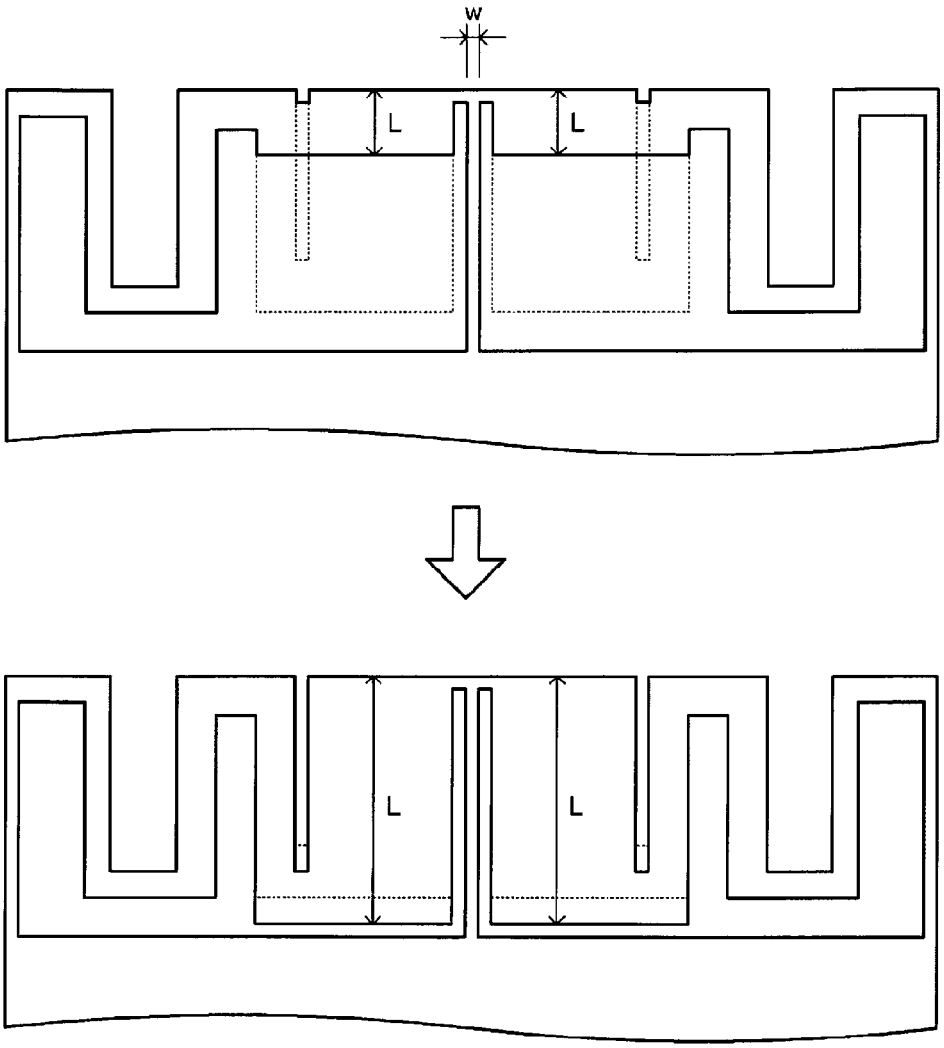
FIG. 2 is a diagram illustrating a mode in which a length L in a vertical direction of a horizontal element of the antenna is changed.
Figure 3A:
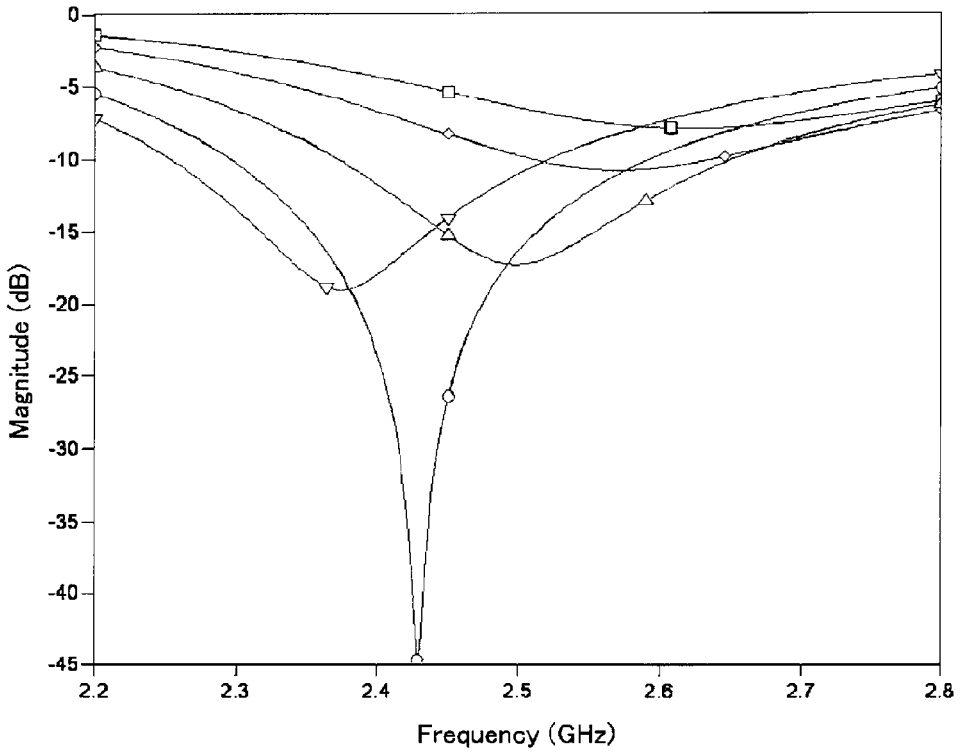
FIGS. 3A and 3B are graphs showing changes in characteristics in a case where the length L in the vertical direction of the horizontal element of the antenna is changed.
Figure 3B:
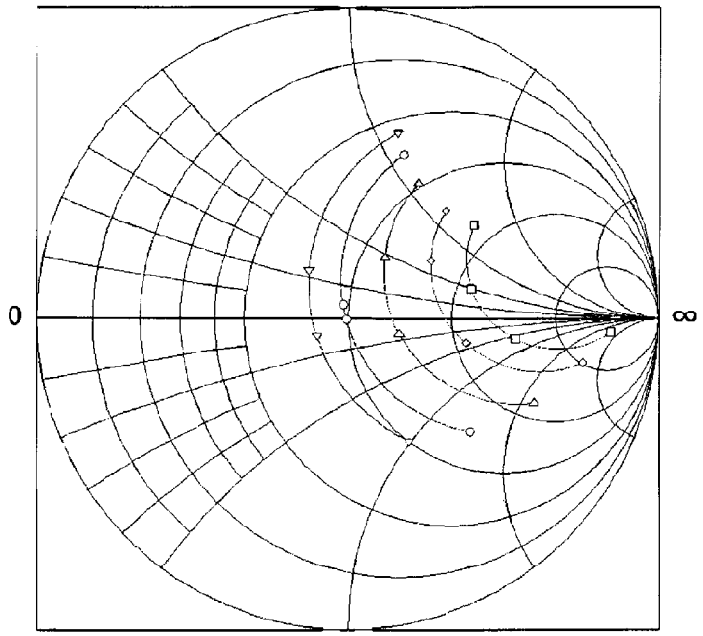

Here, in order to determine the shape of the antenna of FIG. 1, characteristics were simulated using various shapes. First, as shown in FIG. 2, the characteristics are measured by variously changing a length L of the horizontal element 13 in a direction parallel to the vertical element 11. A unit of the length is set to a width w of the vertical element 11. Return loss characteristics and a radiation resistance value were simulated with respect to five types of antennas having the respective lengths of 5w, 11w, 15w, 17w, and 19w. FIG. 3(A) is a graph showing return loss characteristics. FIG. 3(B) is a Smith chart showing impedance characteristics. As shown in FIGS. 3(A) and 3(B), changes in characteristics according to the length of L are sensitive. As L increases, a resonance frequency decreases. When L=17w, a return loss in the resonance frequency, which is approximately −45 dB, is the best. In addition, when L is in a range of 15w to 19w, it can be said that the return loss being equal to or less than −15 dB shows satisfactory characteristics. In addition, an impedance (radiation resistance value) changes according to the length of L and decreases as L increases.

Here, L is expressed using a resonant wavelength λ by setting the resonance frequency of the antenna to 2.45 GHz and setting the width w of the vertical element 11 to 0.5 mm. The relations of 15w=7.5 mm and 19w=9.5 mm are established on the basis of w=0.5 mm. The resonant wavelength λ satisfies the relation of (3.00×10^8/2.45×10^9)×1000=122 mm on the basis of a vacuum propagation speed c=3.00×10^8 m/s of radio waves. When these values are applied, the minimum value of L is expressed by 15w≈λ/16 and the maximum value thereof is expressed by 19w≈λ/13.

However, a wavelength is shortened on the antenna due to a dielectric constant of the circuit board 100. A relative permittivity of the circuit board 100 is ∈r=4.7, and a wavelength shortening coefficient (velocity coefficient) of the circuit board 100 which is calculated on the basis of the relative permittivity is 0.46. However, since the antenna pattern is formed in the surface of the circuit board 100, a shortening coefficient of wavelength on the antenna pattern has a value of anywhere between the shortening coefficient of wavelength of the circuit board 100 and a shortening coefficient of wavelength (=1) in the air. In general, it is considered that the shortening coefficient of wavelength on the antenna pattern has a value of approximately 0.7 to 0.6 which is an intermediate value.

Accordingly, with regard to a maximum range of L, a lower limit is expressed by 15w≈λ/16 using a wavelength λ=122 mm to which a maximum wavelength shortening coefficient (=1) is applied, and an upper limit is expressed by 19w≈λ/6 using a wavelength λ=122×0.46256 mm to which a minimum shortening coefficient of wavelength (=0.46) is applied. Therefore, it is considered that satisfactory characteristics having a little return loss can be expected when the length L of the horizontal element 13 is set to be in a range of λ/16 to λ/6.

Figure 4:
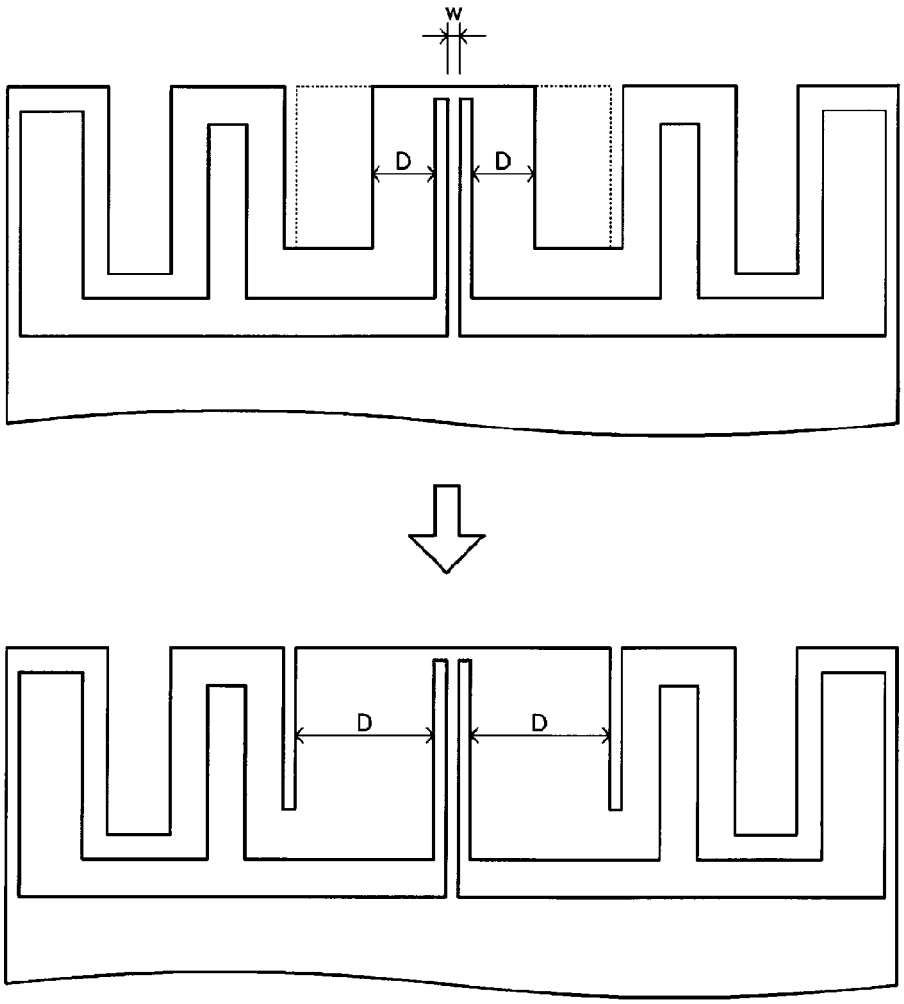
FIG. 4 is a diagram illustrating a mode in which a length D in a horizontal direction of the horizontal element of the antenna is changed.
Figure 5A:
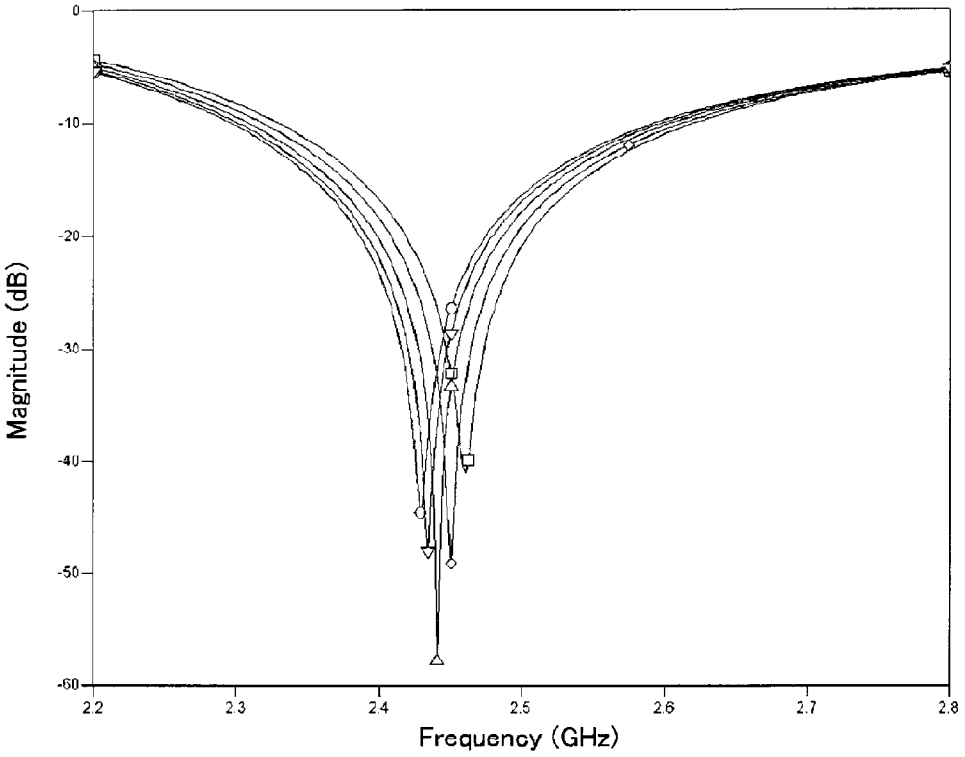
FIGS. 5A and 5B are graphs showing changes in characteristics in a case where the length D in the horizontal direction of the horizontal element of the antenna is changed.
Figure 5B:
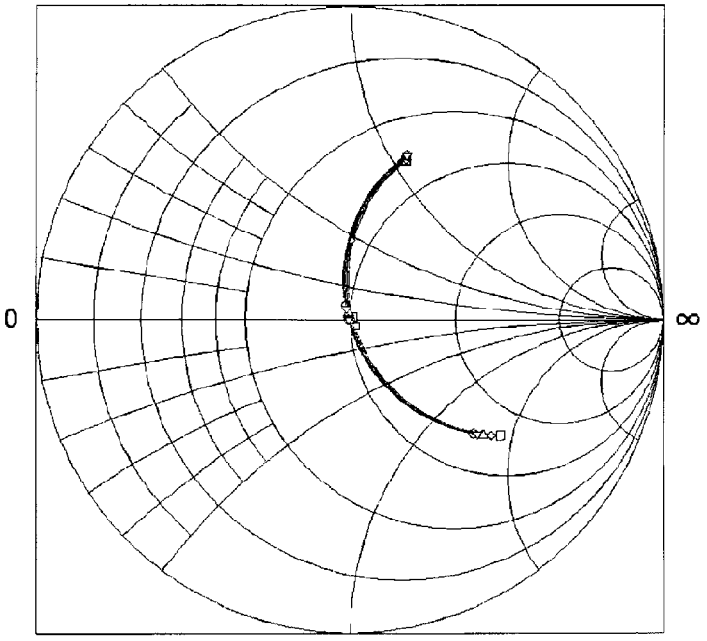

Next, as shown in FIG. 4, characteristics were measured by variously changing a length D of the horizontal element 13 in a direction perpendicular to the vertical element 11. Return loss characteristics and a radiation resistance value are simulated with respect to antennas having the respective lengths D of 3w, 7w, 9w, and 11w. FIG. 5(A) is a graph showing return loss characteristics. FIG. 5(B) is a smith chart showing impedance characteristics. A resonance frequency slightly changes due to the changes in D, but a return loss maintains a value of equal to or less than −40 dB, which is a satisfactory characteristic, across the entire region. In addition, an inductive impedance slightly increases by an increase in D, but a change in the impedance characteristic due to the change in D is small. Thus, it can be understood that the resonance frequency can be finely adjusted by increasing and decreasing D.

Figure 6:
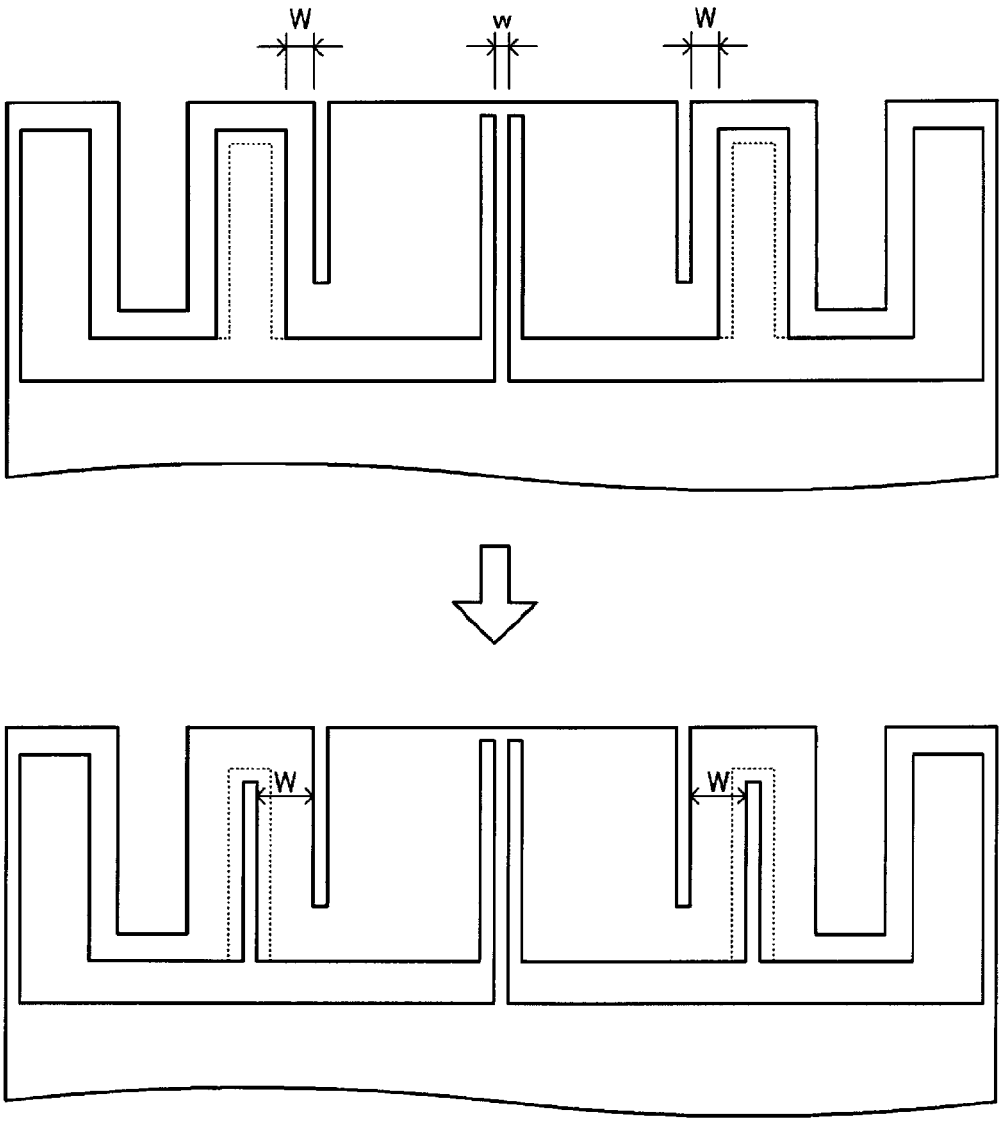
FIG. 6 is a diagram illustrating a mode in which a width W of a short stub of the antenna is changed.
Figure 7A:
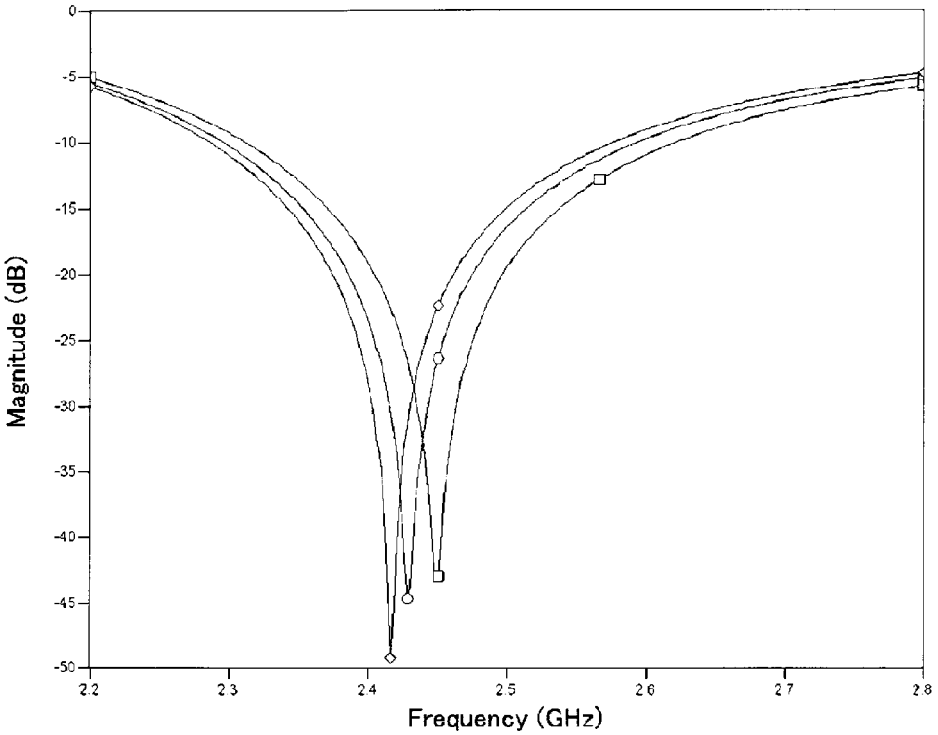
FIGS. 7A and 7B are graphs showing changes in characteristics in a case where the width W of the short stub of the antenna is changed.
Figure 7B:
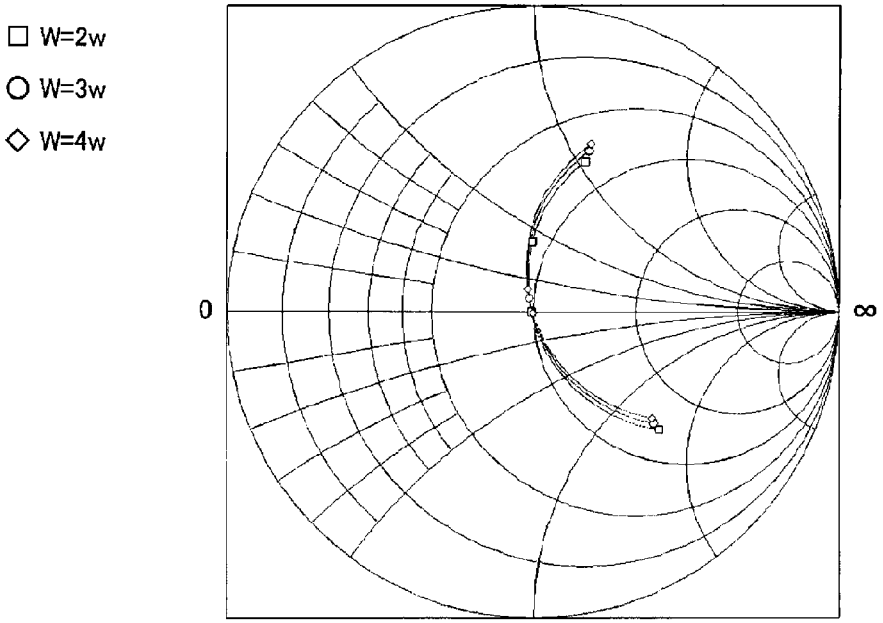

Further, as shown in FIG. 6, characteristics were measured by changing a width W of the short stub 14 to 2w, 3w, and 4w. FIG. 7(A) is a graph showing return loss characteristics. FIG. 7(B) is a smith chart showing impedance characteristics. A resonance frequency slightly changes due to the changes in W, but a return loss maintains a value of equal to or less than −40 dB, which is a satisfactory characteristic, across the entire region. In addition, a capacitive impedance slightly decreases and an inductive impedance slightly increases by an increase in W, but a change in the impedance characteristic due to the change in W is not significant. Thus, it can be understood that the resonance frequency can be finely adjusted by increasing and decreasing W.

In this manner, it was found that the influence of the length L of the horizontal element 13 in a direction parallel to the vertical element 11 on the characteristics of the antenna 1 was significant. In addition, the resonance frequency can be finely adjusted by the length D of the horizontal element 13 in a direction perpendicular to the vertical element 11, but it was found that the inductive impedance increased as D increased. Consequently, the setting of L:D to be in a range of approximately 2:1 to 1:2 can allow the antenna 1 to be given better capacity hat characteristics.

The antenna 1 is formed to have an appropriate dimension on the basis of the above-described simulations. Then, when a resonance frequency is set to approximately 2.45 GHz which is an objective frequency and a high frequency signal of 2.45 GHz is supplied, current density distribution shown in FIG. 8 is shown. In the drawing, a portion having a high concentration in the pattern of the antenna 1 is a location having a high current density, and a portion having a low concentration is a location having a low current density. According to the drawing, the current density is high in an end including the vertical element 11, right and left horizontal elements 13R and 13L on the vertical element 11 side, and descending portions 140R and 140L of right and left short stubs 14R and 14L.

In this manner, the electromagnetic field radiation of the antenna 1 occurs from the vertical element 11, portions of the right and left horizontal elements 13R and 13L, and the right and left short stubs 14, and thus a sufficient effective area of the antenna is secured, which allows a large antenna gain to be obtained with respect to a size.

Since ends of the antenna elements 12R and 12L are connected to right and left connection points 102R and 102L of the ground pattern 101, respectively, an exciting current of the antenna 1 intensively flows to the upper side of the ground pattern 101 without largely spreading throughout the ground pattern 101. Accordingly, the influence of a ground area on the radiation efficiency of the antenna is reduced, and thus the adjustment of the ground pattern 101 according to a substrate size is facilitated.

Figure 9:
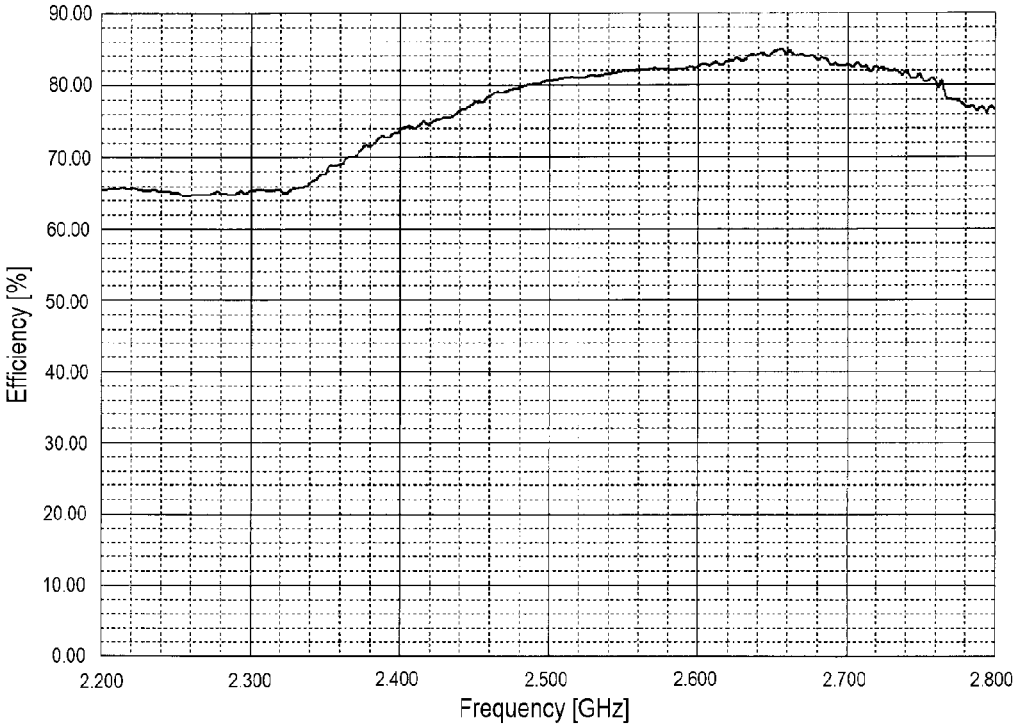
FIG. 9 is a graph showing the radiation efficiency of the antenna.

FIG. 9 is a graph showing the radiation efficiency of the antenna 1 resonated to a frequency of approximately 2.45 GHz. According to the drawing, the radiation efficiency is equal to or greater than 74% in a frequency band of 2.4 GHz to 2.5 GHz, and thus it is possible to obtain the same gain as that of a λ/2 dipole antenna. As described above, in the antenna 1, it can be understood that an electromagnetic field is efficiently radiated in a frequency band including an objective band of 2.45 GHz.

Figure 10:
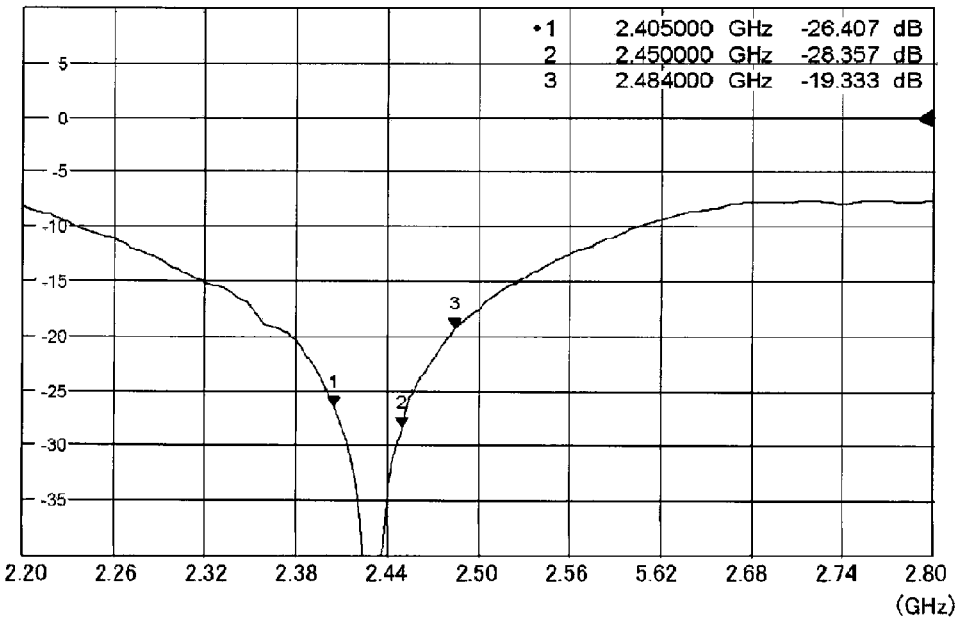
FIG. 10 is a graph showing voltage reflection characteristics of the antenna.

FIG. 10 is a graph showing |S11| characteristics (voltage reflection characteristics) at the feeding point 10 of the antenna 1. As shown in the drawing, the voltage reflection characteristic is equal to or less than −10 dB between approximately 2.23 GHz and 2.60 GHz, and thus it can be understood that matching is performed in a wide band exceeding 300 MHz including an objective band of 2.45 GHz.

Figure 11:
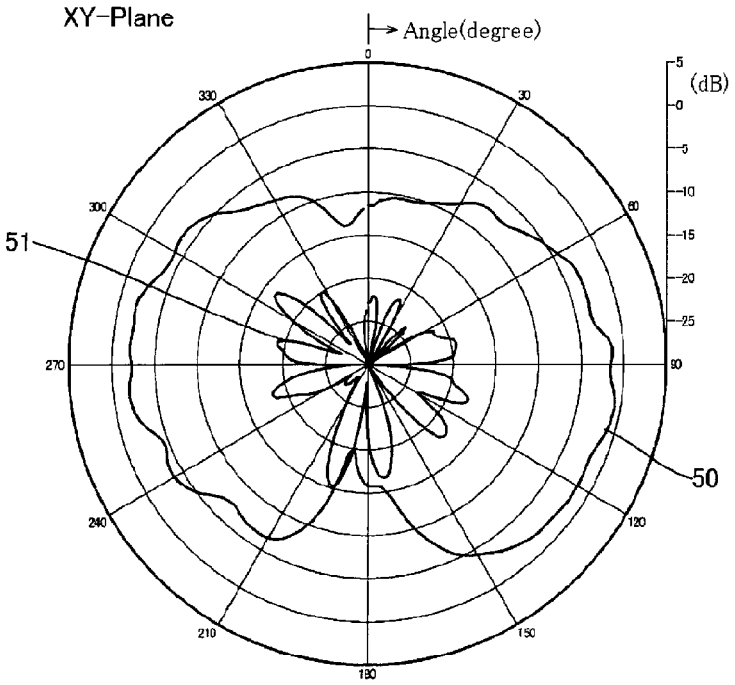
FIG. 11 is a graph showing directional characteristics in an XY plane of the antenna.
Figure 12:
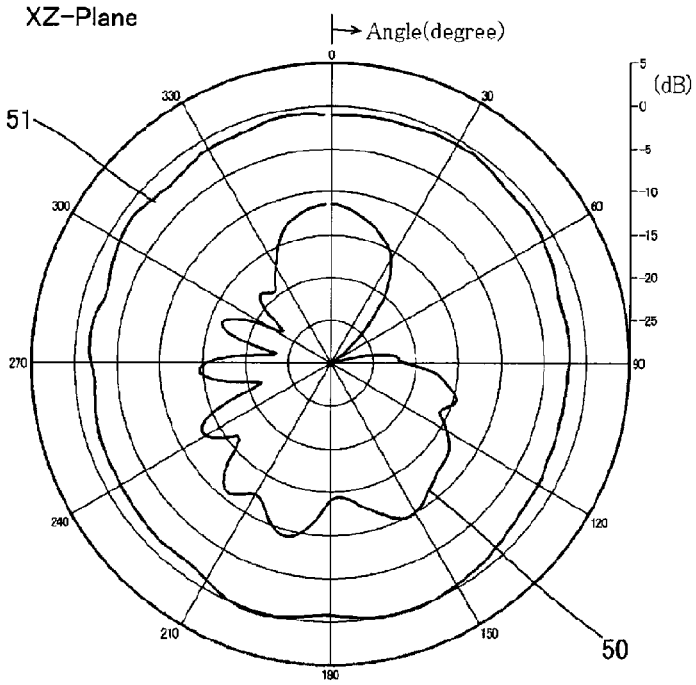
FIG. 12 is a graph showing directional characteristics in an XZ plane of the antenna.
Figure 13:
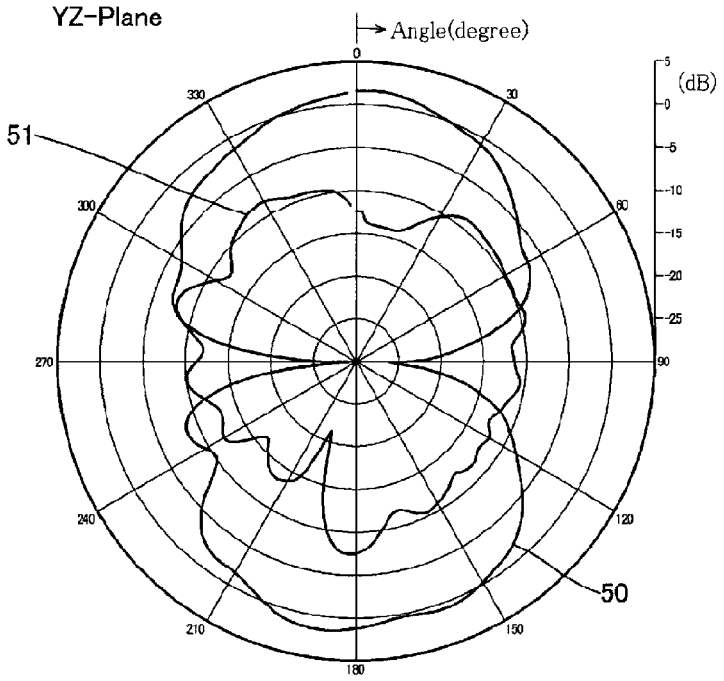
FIG. 13 is a graph showing directional characteristics in a YZ plane of the antenna.

In addition, the antenna 1 having the above-described structure has directional characteristics shown in FIGS. 11 to 13. A measurement frequency is 2.45 GHz. In FIGS. 11 to 13, the reference number 50 denotes a gain curve of a horizontally polarized wave component, and the reference number 51 denotes a gain curve of a vertically polarized wave component. A gain value is represented by a value (dBi) based on an isotropic antenna. FIG. 11 is a graph showing a directional characteristic of 2.45 GHz in an XY plane shown in FIG. 1. In the XY plane, a horizontally polarized wave component shows a gain which is omnidirectionally (particularly, in an x-axis direction) high, and it can be understood that the horizontally polarized wave component is satisfactorily radiated in this arrangement. FIG. 12 is a graph showing a directional characteristic of 2.45 GHz in an XZ plane. In the XZ plane, a vertically polarized wave component shows an extremely high gain which is omnidirectionally close to approximately 0 dB. In this arrangement, that is, when the vertical element 11 is set to be perpendicular to the ground, it can be understood that the vertically polarized wave component in particular is satisfactorily radiated with non-directivity. In addition, FIG. 13 is a graph showing a directional characteristic of 2.45 GHz in a YZ plane. In the YZ plane, a vertically polarized wave component shows a gain which is almost high omnidirectionally, and a horizontally polarized wave component has bidirectional characteristics of a figure eight. The maximum gain is 1.8 dBi, and thus it can be understood that a gain which is substantially the same as that of a dipole antenna is obtained.

Figure 14A:
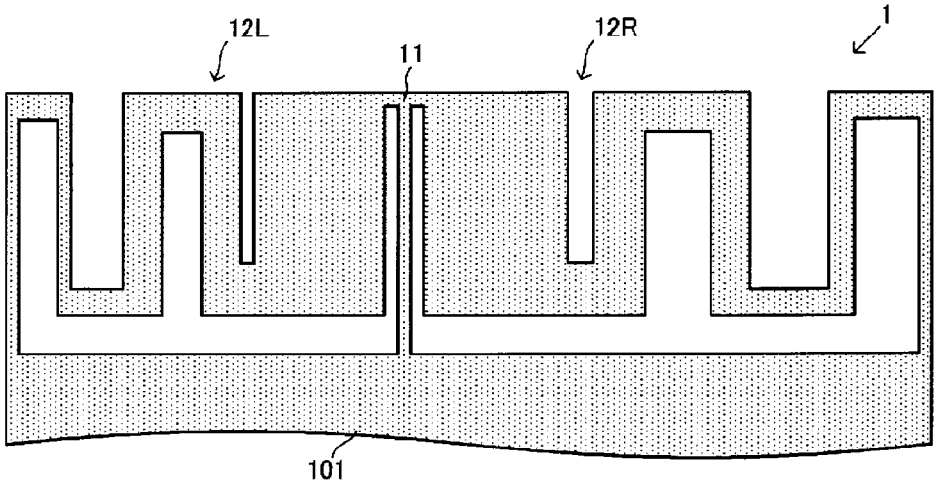
FIG. 14A is a diagram showing a modified example of the antenna.

In the above-described embodiment, as shown in FIG. 1, the antenna elements 12R and 12L are symmetrically disposed, and the right and left short stubs 14R and 14L meander up and down. However, the antenna of the present invention is not limited to this shape. For example, as shown in FIG. 14A, the right and left antenna elements 12R and 12L may be asymmetrically formed. It is possible to arbitrarily change the directional characteristics shown in FIGS. 11 to 13 by changing right and left balance. In FIG. 14A, the lengths of the right and left antenna elements 12R and 12L in the horizontal direction are changed by shifting the vertical element 11 to the left, but the asymmetric form is not limited thereto.

Figure 14B:
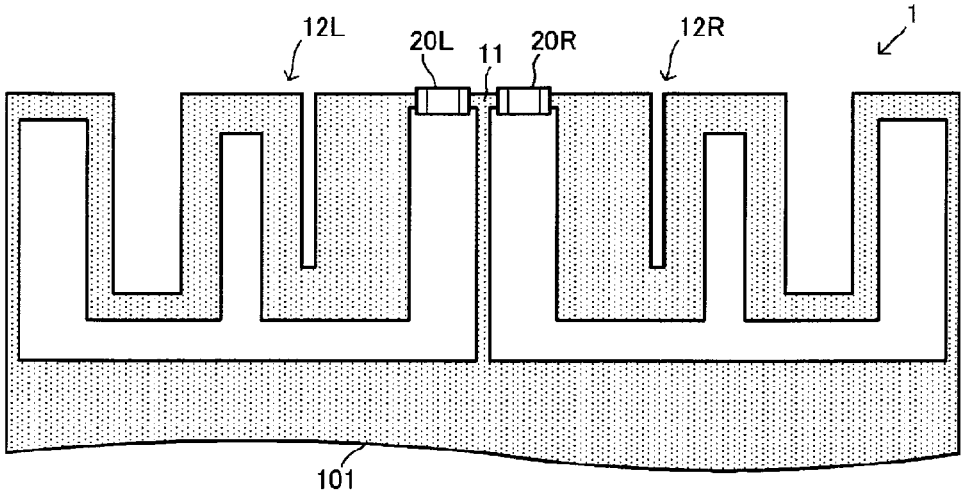
FIG. 14B is a diagram showing another modified example of the antenna.

In addition, as shown in FIG. 14B, chip capacitors 20R and 20L may be inserted into the line, in addition to (or instead of) the horizontal elements 13R and 13L having a wide width and given capacitance. The resonance frequency can be shifted to a lower frequency side by increasing the capacitance of the antenna elements 12R and 12L. In addition, inductors such as coils may be inserted into the short stubs 14R and 14L. Further, a slit may be provided in the horizontal elements 13R and 13L so as to adjust capacitance and inductance.

Figure 14C:
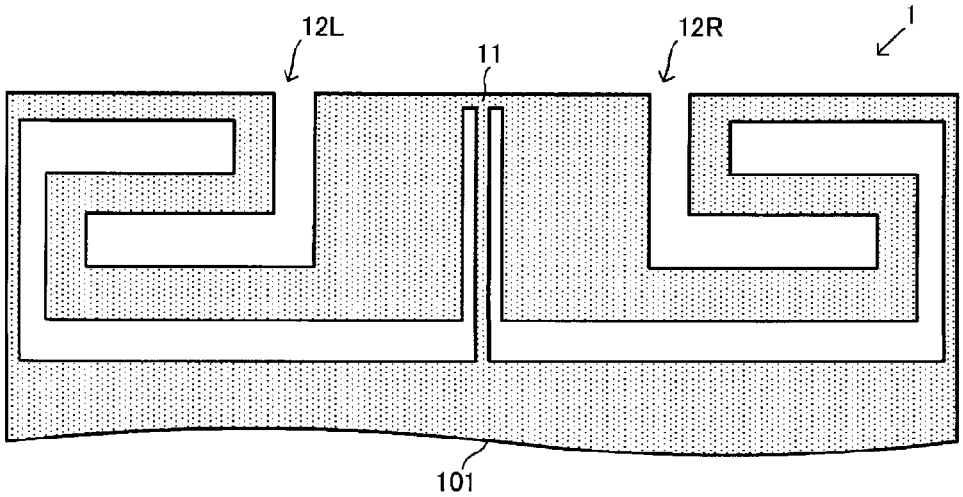
FIG. 14C is a diagram showing still another modified example of the antenna.

In addition, as shown in FIG. 14C, the short stubs 14R and 14L may be formed upwards from below while meandering right and left. In this manner, it is possible to change the directional characteristics of the antenna by changing the direction of the meandering. However, even when the meandering is performed in any manner, the descending portions 140R and 140L at both ends of the short stubs 14R and 14L are made to conform to the right and left sides of the ground pattern 101.

Meanwhile, in the above-described embodiment, the width w of the vertical element 11 is set to 0.5 mm, but can be appropriately changed. However, the width is preferably a length which is sufficiently lower than the resonant wavelength $\lambda$, for example, equal to or less than $1/100$ of the resonant wavelength $\lambda$. In addition, it is preferable that the length of the vertical element 11 and the length of the descending portion 140 of the short stub be approximately 10 mm, that is, approximately $\lambda/12$ to $\lambda/6$, but it is possible to shorten the lengths by adding a coil, or the like.

Meanwhile, in this embodiment, a description has been made of the pattern antenna in which a pattern is formed in the surface of the circuit board 100 which is a dielectric body. However, the structure of the present invention may be used in a patch antenna using a microstrip formed on a double-sided substrate, or the structure of the present invention may be used in a chip antenna. In addition, a portion of the line of the pattern antenna may include a portion other than a printed wiring pattern such as a chip part, for example, as shown in FIG. 14B. In addition, it is possible to replace the short stub 14 of the above-described embodiment with a coil. Further, the antenna may be constituted using a metal plate and a wire instead of the pattern on the circuit board 100.

In addition, the antenna 1 of this embodiment can be used not only as a transmission antenna but also as a reception antenna.

The application is based on Japanese Patent Application No. 2012-134795 filed on Jun. 14, 2012 and Japanese Patent Application No. 2013-24551 filed on Feb. 12, 2013, the contents of which are incorporated herein by reference.

REFERENCE SIGNS LIST

1: Antenna
10: Feeding point
11: Vertical element
12: Antenna element
13: Horizontal element
14: Short stub

The invention claimed is:

1. A planar antenna comprising the following formed on a plane thereof:

a substantially rectangular ground pattern that has an upper side which is below and formed with an antenna element, the antenna element including:

a substantially linear vertical element that is formed from a feed point and in a vertical direction from the upper side of the ground pattern to an upper boundary of the antenna element;

a left branch line that is orthogonally branched to the left from the top of the vertical element to a top of a left substantially rectangular element;

a right branch line that is orthogonally branched to the right from the top of the vertical element to a top of a right substantially rectangular element;

the left substantially rectangular element has a length or width that extends from the upper boundary of the antenna element towards the upper side of the ground pattern, wherein a gap of substantially constant width is formed between the substantially linear vertical element and the left substantially rectangular element;

the right substantially rectangular element has a length or width that extends from the upper boundary of the antenna element towards the upper side of the ground pattern, wherein a gap of substantially constant width is formed between the substantially linear vertical element and the right substantially rectangular element;

a left shorting element that is formed in a meander shape between the upper side of the ground pattern and the upper boundary of the antenna element and connects the bottom of the left substantially rectangular element to the left side of the ground pattern, wherein the left side of the left shorting element conforms to the left side of the ground pattern to form a continuous left side of the planar antenna from the lower side of the ground pattern to the upper boundary of the antenna element; and a right shorting element that is formed in a meander shape between the upper side of the ground pattern and the upper boundary of the antenna element and connects the bottom of the right substantially rectangular element to the right side of the ground pattern, wherein the right side of the right shorting element conforms to the right side of the ground pattern to form a continuous right side of the planar antenna from the lower side of the ground pattern to the upper boundary of the antenna element.

2. The antenna according to claim 1, wherein the right and left substantially rectangular elements have a flat rectangular shape in which a length of the right and left horizontal elements in a direction from the top of the vertical element to the ground pattern is equal to or greater than 1/16 and equal to or less than 1/6 of a resonant wavelength of the antenna.

3. The antenna according to claim 1, wherein each of the right and left substantially rectangular elements has a vertical side and a horizontal side which range within 1:2 to 2:1.

4. The antenna according to claim 1, wherein a left antenna element constituted by the left substantially rectangular element and the left shorting element is asymmetrical to a right antenna element constituted by the right substantially rectangular element and the right shorting element with respect to the substantially linear vertical element as an axis.

5. The antenna according to claim 1, further comprising:

capacitors disposed on the right and left substantially rectangular elements.

6. The antenna according to claim 1, further comprising:

inductors disposed on the right and left shorting elements.

* * * * *